United States Patent [19]

Richards et al.

[11] Patent Number: 4,683,610

[45] Date of Patent: Aug. 4, 1987

[54] HANDLE EXTENSION

[75] Inventors: John O. Richards, Hemet, Calif.; John Graef, Middleburg Heights, Ohio

[73] Assignee: Universal Extension Corporation, Cleveland, Ohio

[21] Appl. No.: 729,669

[22] Filed: May 2, 1985

[51] Int. Cl.[4] ..... B25G 1/04

[52] U.S. Cl. ..... 16/115; 16/DIG. 25; 16/DIG. 41; 403/309; 403/313

[58] Field of Search ..... 16/115, DIG. 25, DIG. 41; 15/143 B, 144 B; 403/290, 309, 310, 313

[56] References Cited

U.S. PATENT DOCUMENTS

| | | | |
|---|---|---|---|
| 1,112,517 | 10/1914 | Boisvert | 16/115 |
| 1,154,704 | 9/1915 | Leyson . | |
| 1,301,475 | 4/1919 | Mellin . | |
| 1,769,967 | 7/1930 | Saurman et al. | 403/290 |
| 2,841,425 | 1/1958 | Oeters . | |
| 2,881,018 | 4/1959 | Carlson et al. . | |
| 2,984,852 | 5/1961 | George | 15/144 B |
| 3,170,721 | 2/1965 | Wells et al. . | |
| 3,239,243 | 3/1966 | Grellsson . | |
| 3,284,103 | 11/1966 | Polzin et al. | 16/115 |
| 3,380,097 | 4/1968 | Pharris | 16/115 |
| 3,404,427 | 10/1968 | Mack . | |
| 3,835,535 | 9/1974 | Robison et al. | 16/115 |
| 4,029,279 | 6/1977 | Nakatani . | |
| 4,111,575 | 9/1978 | Hoshino . | |

FOREIGN PATENT DOCUMENTS

| | | | |
|---|---|---|---|
| 2139545 | 11/1984 | United Kingdom | 16/115 |

*Primary Examiner*—E. R. Kazenske
*Assistant Examiner*—James L. Wolfe
*Attorney, Agent, or Firm*—Sand & Hudak

[57] ABSTRACT

An extension for a handle of a tool or similar device includes a hollow cylindrical shaped tube formed with a series of circumferentially spaced slots that provide intervening strips of tube material adjacent to but spaced from an open end of the tube. A manually operated clamping band encircles the strips of tube material and clamps the strip against a handle inserted into the tube bore. A second pair of circumferentially spaced slots and intervening strips of the material may be formed adjacent to the first series of strips and is encircled by another clamp for increasing the grip on a handle inserted into the tube.

8 Claims, 8 Drawing Figures

HANDLE EXTENSION

TECHNICAL FIELD

The invention relates to a device for attaching to the handle of a tool for extending the length of the handle. More particularly, the invention relates to a handle extension which is of a simple rugged one piece construction having an improved gripping area or areas for securely gripping the handle of a tool telescopically inserted through an open end of the handle extension.

BACKGROUND ART

Various types of extension devices for handles, poles, etc. have been devised whereby the handle of a tool may be mounted or gripped thereby for extending the effective length of the tool. Most of the known handle extensions include a plurality of components, such as a tapered sleeve which slides over a plurality of slotted fingers formed on the open end of a tube such as shown in U.S. Pat. No. 2,841,425. Such open-ended, slotted finger arrangement requires a tight wedging action by the slidable outer sleeve in order to securely grip a handle inserted therein. Such sleeves are difficult to move in the opposite direction for release of the handle and the fingers apply gripping pressure only at the outer ends of the fingers.

Other prior art handle extensions require various threaded connections and locking devices for securing the handle on the extension device such as shown in U.S. Pat. Nos. 1,154,704; 1,301,475; 2,881,018; 3,170,721; 3,404,427; 4,029,279; and 4,111,575. Most of these prior art handle extensions are complicated and expensive to produce due to the various connecting components and threaded clamping members. Although these prior extension devices do provide clamping engagement with a tool handle, they do not in many applications provide the clamping force required to resist repeated and forceful movement of the tool handle. Furthermore, the clamping members of these prior handle extensions require precisioned matched components to work effectively. Also, these prior extensions are formed of heavy wall metal tubes or the like which increases both the cost and weight of the handle extension.

Therefore, the need has existed for an improved handle extension which is rugged, lightweight and easy to use, yet which provides a extremely secure grip when mounted on a handle for extending the effective length on the tool with which it is used.

DISCLOSURE OF THE INVENTION

Objectives of the invention include providing an improved handle extension which is formed of a lightweight tubular material, preferably dielectric, which enables the extension to be used in a hazardous electric environment, and in which the tube preferably is formed of a rugged inexpensive plastic material. Another objective is to provide such a handle extension in which the cylindrical shaped tube is formed with one or more clamping areas adjacent an open end of the tube formed by longitudinally extending slots and intervening strips of tubular material connected integrally with the remainder of the tube, and in which a solid annular tubular portion remains adjacent to the open end of the tube.

Another objective is to provide such a device in which an extremely simple and easily operated clamping band encircles the tube at the clamping area for collapsing the circumferentially spaced strips of tube material tightly against a handle of a tool telescopically inserted within the tube bore. Still another objective is to provide such a device in which alignment nubs or bands are formed on the spaced strips to align the clamping band at the center of the clamping area.

A still further objective of the invention is to provide such a handle extension in which the slots have a generally oval configuration to increase the movement and flexibility of the intervening strips of tube material, and in which the clamp can be tightened manually by rotation of a wingnut or tightened more securely with a screwdriver or similar tool.

These objectives and advantages are obtained by the improved handle extension of the invention, the general nature of which may be stated as including an elongated cylindrical-shaped tube having a hollow bore terminating in at least one open end; a plurality of longitudinally extending slots formed in the tube and spaced inwardly from the open end forming a plurality of circumferentially spaced flexible strips of material integral with the tube; an annular band of tube material located between the ends of the strips and said open end; and clamp means encircling the tube generally at a longitudinal center of the tube strips for compressing the strips radially inwardly for gripping a handle telescopically inserted into the tube bore through the open end.

BRIEF DESCRIPTION OF THE DRAWINGS

Preferred embodiments of the invention, illustrative of the best mode in which applicants have contemplated applying the principles, are set forth in the following description and are shown in the drawings and are particularly and distinctly set forth in the appended claims.

Similar numerals refer to similar parts throughout the drawings.

BEST MODE FOR CARRYING OUT THE INVENTION

Figure 1:
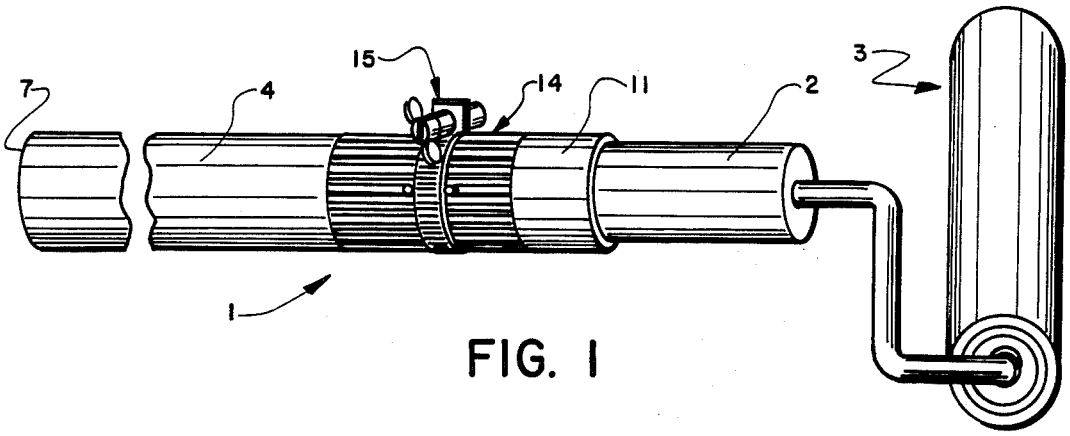
FIG. 1 is a fragmentary perspective view showing the improved handle extension mounted on the handle of a usual paint applicator.
Figure 2:
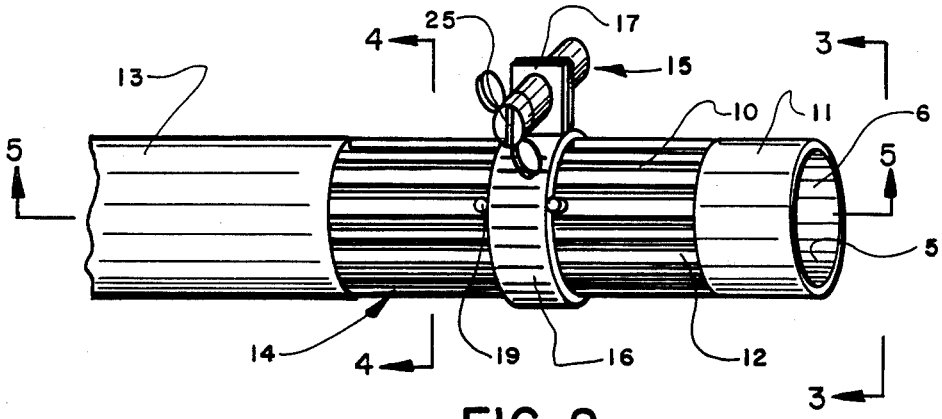
FIG. 2 is an enlarged fragmentary view of the clamping end of the handle extension of FIG. 1.
Figure 3:
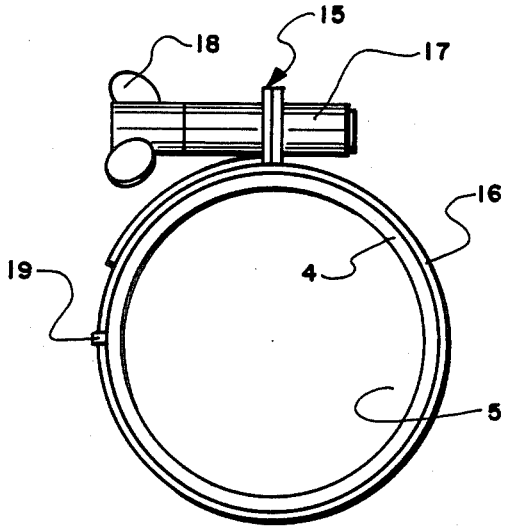
FIG. 3 is an enlarged end view looking in the direction of arrows 3—3, FIG. 2.
Figure 4:
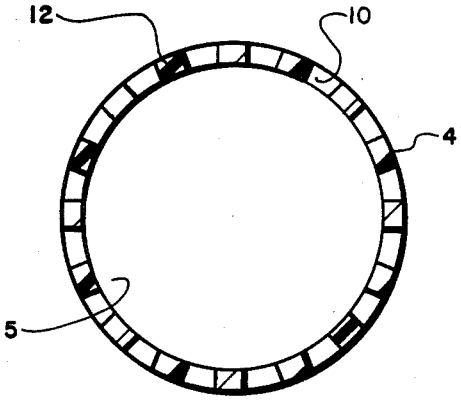
FIG. 4 is an enlarged fragmentary sectional view taken on line 4—4, FIG. 2.

The improved handle extension is indicated generally at 1, and is shown in FIG. 1 gripping a handle 2 of a usual type of paint roll applicator, indicated generally at 3. Applicator 3 is just one of the many tools and devices which can be used with improved handle extension 1. Preferably the particular tool to be extended by extension 1 will preferably have a cylindrical shaped handle and may be of various lengths.

Handle extension 1 is a cylindrical-shaped hollow tube of material formed by a cylindrical wall 4 and having a central bore 5 terminating at one end in an open end 6. The opposite tube end 7 may be opened or closed without affecting the concept of the invention. Preferably, handle extension 1 is formed of a sturdy dielectric plastic material to provide insulation for certain applications in which the particular tool grip thereby could come into contact with electrical wires or other electrical equipment. Handle extension 1 also may be formed of a lightweight aluminum, fiberglass or similar material although a rugged dielectric plastic material is preferred. Also the particular length of the handle extension may vary without affecting the concept of the invention, with a preferred length being approximately three feet.

In accordance with one of the main features of the invention, a series of circumferentially spaced longitudinally extending slots 10 are formed in the outer end of cylindrical tube wall 4 adjacent open end 6 but spaced inwardly therefrom and providing a solid annular ring or collar 11 of tube material. Slots 10 form a series of intervening strips of tube material 12 which are integral with collar 11 and the remaining portion 13 of cylindrical wall 4 and together form a clamping area indicated generally at 14. The particular width and length of slots 10 and intervening material strips 12 may vary. In one embodiment the inside diameter of the tube preferably is 7/8 inch to 1 inch with the length of slots 10 and strips 12 being approximately 3 inches. Also strips 12 and slots 10 will have rectangular configurations.

Figure 5:
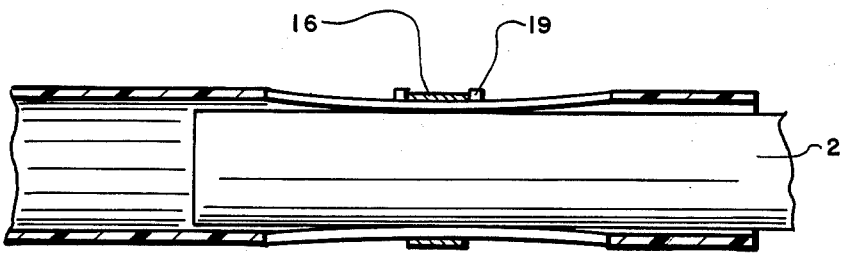
FIG. 5 is a fragmentary sectional view taken on line 5—5, FIG. 2.

A manually operated clamping member, indiciated generally at 15, which comprises a flexible metal band 16 and a manually operated clamp 17 is mounted on clamping area 14 of tube wall 4 with band 16 being located generally at and encircling the midpoint of area 14. Manual manipulation of a wingnut 18 of clamping member 15 will tighten band 16 about clamping area 14 which will radially compress strips 12 inwardly and clamp the strips uniformly against handle 2 which is telescopically inserted therein as shown in FIG. 5. Strips 12 provide a plurality of longitudinal pressure areas circumferentially about the handle instead of pressure points as in prior handle extensions. A pair of nubs 19 may be formed on one or more of strips 12 to position clamping band 16 at the midpoint of clamping area 14. Clamping member 15 may be a type of clamp commonly referred to as a hose clamp in which band 16 is formed with a series of slots which engage a or nut of clamp 17 to advance band 16 through clamp 17 as the clamp is rotated by wingnut 18.

Thus, handle 2 of numerous types of tools is telescopically inserted into bore 5 through open end 6 and projects several inches or more beyond the location of band 16 after which band 16 is clamped tightly against strips 12 securely gripping and maintaining handle 2 within the extension. The location of the clamping member 15 rearwardly from and in composition with the rigid open end provided by collar 11 prevents a rocking movement of the handle within the tube. It is understood that the diameter of handle 2 is generally complementary to the internal diameter of tube bore 5.

Figure 6:
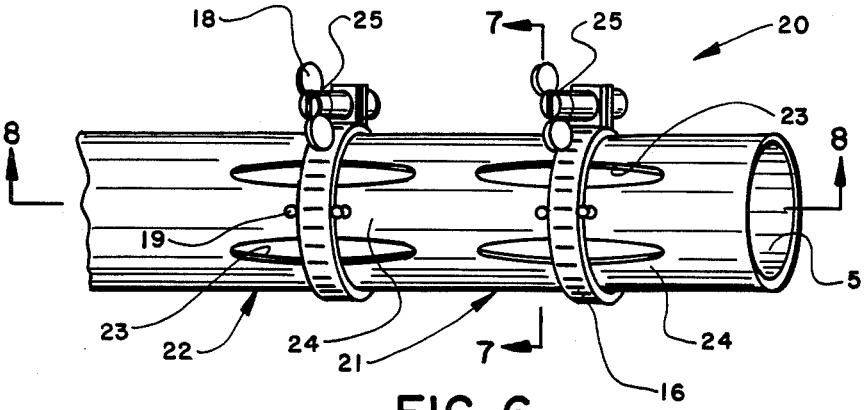
FIG. 6 is a fragmentary perspective view of the clamping end of a modified embodiment of the improved handle extension.
Figure 7:
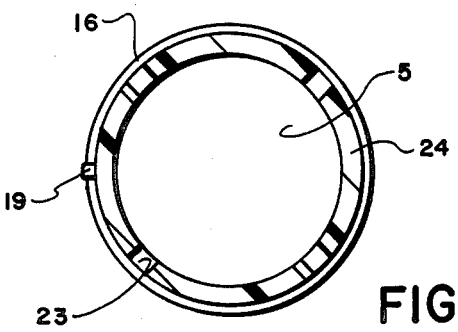
FIG. 7 is an enlarged sectional view taken on line 7—7, FIG. 6.
Figure 8:
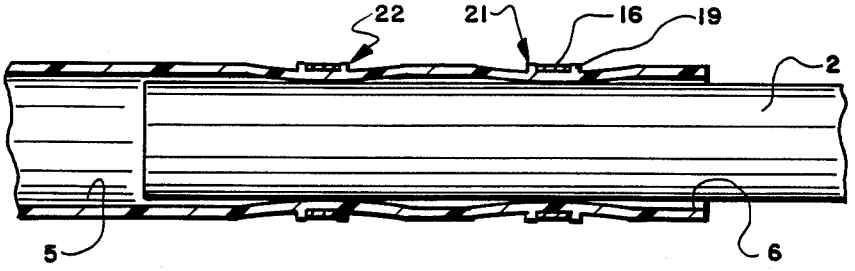
FIG. 8 is a longitudinal sectional view taken on line 8—8, FIG. 6.

A modified form of handle extension 1 is indicated generally at 20 and is shown in FIGS. 6–8. Extension 20 is similar in many respect to handle extension 1 described above. Handle 20 is formed with two axially spaced clamping areas indicated generally at 21 and 22, each of which is formed by four equally circumferentially spaced slots 23 which form intervening strips of tube material 24 which are integrally connected with the remaining portions of cylindrical tube wall 4 as are strips 12 of extension 1. This slotted arrangement will provide a wider intervening material strip 24 than that provided by the greater number of closer spaced rectangular shaped slots 10 and intervening strips 12 of handle extension 1. Slots 23 have a generally oval configuration enabling the intervening strips of tube material 24 to collapse more easily against the handle of a tool inserted therein. A pair of clamping members 15 are telescopically mounted about clamping areas 21 and 22 in the same manner as for handle extension 1.

Modified handle extension 20 provides increased gripping power on a tool handle inserted therein by providing spaced areas of pressure against the handle, each of which provides four longitudinally extending pressure zones circumferentially spaced about the handle at spaced axial locations on the handle. This clamping engagement in combination with the rigid collar portion 11 adjacent the open end 6, provides increased gripping power than that of handle extension 1 and is desirable when the particular tool is used for heavier workloads such as for concrete spreading tools, or other instruments used in an outside environment than the paint applicator 3 shown mounted in handle extension 1.

Clamping members 15 may be provided with a slot 25 at one end of clamp 17 for receiving the edge of a screwdriver for tightening band 16 about the inserted handle in addition to wingnut 18. Nubs 19 also may be formed integrally with material strips 24 to center the pair of clamping bands 16 on handle extension 20. Nubs 19 may be replaced with one or a pair of elastic rings or raised areas placed about the center of the clamping areas for centering the clamping bands thereon without affecting the concept of the invention. Also, a painted ring could be placed on the compression strips which would facilitate the centering of the clamping band.

The slots located between the intervening tube strips should be wide enough so that the strips will not come together before becoming clamped tightly about a handle inserted within the tube end to prevent the clamps from tightly pressing the strips against the inserted handle. Slots 23 of handle extension 20 are rounded at the end to provide a good appearance and to keep the ends of these slots from cracking. Also, these rounded ends provided by the oval shape of the slots enables the intervening material strips to resume their original position after the clamping pressure has been released therefrom. Also, the two clamping areas of handle extension 20 keep various size handles from moving inside the tube when the clamps are tightened to provide increased gripping. An important feature of the invention is the preferable formation of the tube of a dielectric material. Also, the improved handle extension is clamped from the outside and will hold firmly around any cylindrical shaped handle. The tube is a single one piece member which can be telescopically mounted with other similar handle extension to increase the overall length of the extension. However, for most applications, a single tube length of several feet will work satisfactory and eliminate the multiple components and sections required in many prior handle extensions.

The improved handle extension is adaptable for a small range of tool handle sizes for a single size cylindrical tube since the inwardly compression of the gripping strips may accommodate a range of inserted handle sizes. Also, the diameter of cylindrical wall 4 may come in various sizes to provide a complete range of handle extension sizes to cover most all applications where such a handle extension would be desirable. Another important feature is the solid outer tube end provided by collar 11 which is the integral area of tube material that connects the remaining portion of the tube with strips 12 and 24. This provides for a stronger extension than other handle extensions in which a plurality of fingers are formed at the outer end of a tube having no interconnecting outer collar as that of the present invention.

Although handle extensions 1 and 20 are described for use with tool handles, they can be used with tent poles, clothesline poles, flag poles or other types of instruments having a generally cylindrical shaped member.

Accordingly, the improved handle extension construction is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved handle extension is constructed and used, the characteristics of the construction, and the advantageous, new and useful results obtained; the new and useful structures, devices, elements, arrangements, parts, and combinations, are set forth in the appended claims.

What is claimed is:

1. A handle extension including:

(a) an elongated tube having longitudinal ends and being formed by a cylindrical wall having a hollow bore therethrough and one of said ends terminating in at least one open end;

(b) a plurality of longitudinally extending slots formed in the tube and extending completely through the cylindrical wall and into the hollow bore, the ends of said slots being longitudinally spaced inwardly from the ends of said tube and forming a plurality of circumferentially spaced flexible strips of material integral with the tube;

(c) said tube having a circumferentially continuous annular band portion of tube material located between said slots and said open end;

said annular band portion, said strips and the remainder of said tube being integral; and (d) clamp means encircling the tube generally at a longitudinal center of the strips for compressing the strips radially inwardly for gripping a handle telescopically inserted into the tube bore through the open end.

2. The handle extension defined in claim 1 in which the tube bore extends throughout the longitudinal length of the tube; and in which the tube is formed with an open end at both ends thereof.

3. The handle extension defined in claim 1 in which the tube is formed of a dielectric material.

4. The handle extension defined in claim 1 in which the tube is formed with four slots which form four equally circumferentially spaced strips of intervening tube material.

5. The handle extension defined in claim 4 in which each of the slots have a generally oval configuration.

6. The handle extension defined in claim 4 in which a second series of four slots is formed in the tube to form a second series of four strips located adjacent to and spaced axially from the first four strips; and in which second clamp means encircles the second series of strips for gripping a handle at two spaced locations when telescopically inserted into the tube bore.

7. The handle extension defined in claim 1 in which the clamp means is a flexible metal band and a rotatable clamp for tightening the band about the circumferentially spaced strips.

8. The handle extension defined in claim 1 in which each of the strips is approximately 3 inches long; and in which the tube is approximately 3 feet long.

* * * * *